US006023889A

United States Patent [19]

Husting et al.

[11] Patent Number: 6,023,889

[45] Date of Patent: Feb. 15, 2000

[54] ADJUSTABLE WALL JAMB

[75] Inventors: Thomas J. Husting, Port Washington; Thomas A. Bonnell, Sheboygan, both of Wis.

[73] Assignee: Kohler Co., Kohler, Wis.

[21] Appl. No.: 08/845,855

[22] Filed: Apr. 28, 1997

Related U.S. Application Data

[62] Division of application No. 08/616,168, Mar. 14, 1996, Pat. No. 5,694,722, which is a continuation of application No. 08/184,077, Jan. 18, 1994.

[51] Int. Cl.[7] ..... A47K 3/16

[52] U.S. Cl. ..... 52/35; 52/204.591; 52/210; 52/239; 52/716.8; 4/614; 4/607; 49/404; 49/390

[58] Field of Search ..... 52/35, 204, 591, 52/204.5, 97, 217, 716.8, 204.55, 204.56, 288.1, 204.64, 210, 208, 239; 4/610, 607, 609, 595, 614; 49/404, 390

[56] References Cited

U.S. PATENT DOCUMENTS

| | | | |
|---|---|---|---|
| 1,498,201 | 6/1924 | Reeves et al. . | |
| 1,724,186 | 8/1929 | Fox . | |
| 2,169,713 | 8/1939 | Stroud | 20/56.5 |
| 2,791,004 | 5/1957 | Sullivan | 20/11 |
| 2,856,040 | 10/1958 | Dansereau | 189/46 |
| 3,420,021 | 1/1969 | Anghinetti et al. | 52/288.1 X |
| 3,440,767 | 4/1969 | Allgeyer et al. | 49/404 |
| 3,468,064 | 9/1969 | Fraleigh et al. | 49/413 |
| 3,900,966 | 8/1975 | Suarez | 49/390 |
| 4,006,569 | 2/1977 | Kain | 52/397 |
| 4,184,297 | 1/1980 | Casamayor | 52/202 |
| 4,193,605 | 3/1980 | Josephson | 277/184 |
| 4,240,235 | 12/1980 | Nawa . | |
| 4,453,346 | 6/1984 | Powell et al. | 49/404 |
| 4,537,002 | 8/1985 | Ellingson | 52/403 |
| 4,599,833 | 7/1986 | Bullock . | |
| 4,628,655 | 12/1986 | Scheiderer . | |
| 4,640,072 | 2/1987 | Muhle . | |
| 4,775,570 | 10/1988 | Ohlenforst et al. . | |
| 4,825,612 | 5/1989 | Tupman | 52/288.1 X |
| 4,914,770 | 4/1990 | Baus . | |
| 5,079,880 | 1/1992 | Reid | 52/716.2 X |
| 5,671,488 | 9/1997 | Greferath | 4/607 |

FOREIGN PATENT DOCUMENTS

| | | |
|---|---|---|
| 2587742 | 3/1987 | France . |
| 4119628 | 7/1992 | Germany . |

*Primary Examiner*—Carl D. Friedman
*Assistant Examiner*—Winnie S. Yip
*Attorney, Agent, or Firm*—Quarles & Brady LLP

[57] ABSTRACT

An adjustable wall jamb is disclosed which can compensate for a variety of variations in wall structures when fitting a panel member thereto. One adjustable wall jamb is for a shower enclosure and affords a channel into which a portion of the wall panel is sealed, and thus provides a "floating" type seal without contacting an end of the adjustable wall jamb. The adjustable wall jamb is formed as a support post and is telescopingly fitted into a stud jamb. In an alternative embodiment, there is a one-piece adjustable wall jamb having securing flanges and sealing fingers formed as a one-piece unit. This can be utilized in conjunction with the square fitment of a panel to a wall, a corner construction, or an angled construction.

4 Claims, 3 Drawing Sheets

ADJUSTABLE WALL JAMB

This is a division of application Ser. No. 08/616,168 filed Mar. 14, 1996 now U.S. Pat. No. 5,694,722, which is a File Wrapper Continuation of Ser. No. 08/184,077 filed Jan. 18, 1994.

BACKGROUND OF THE INVENTION

A. Field of the Invention

This invention relates primarily to devices for securing panels to walls. More particularly, the invention relates to wall jambs for connecting shower wall panels to support walls.

B. Description of the Art

The securing of wall panels to support walls poses many problems. For example, in many instances the support wall is not plumb. In addition, wall finish thickness can vary from ¾ inch to in excess of 1½ inches. In connection with walls for bathing facilities, there is the additional problem of providing a water tight seal. Still other problems arise when attempting to make final adjustments of the panel in the wall jamb given that glass can easily be scratched.

There is currently available an adjustable wall jamb for bathing fixture panels. This is described in U.S. Pat. No. 4,453,346. While this adjustable wall jamb works well from a sealing and adjustment standpoint, there is a need for an improved wall jamb.

SUMMARY OF THE INVENTION

In one aspect, the invention provides an adjustable wall jamb for mounting a panel member wherein a first member is adapted to be connected to a wall support and has a channel portion adapted for receiving the panel. A sealing member having resilient fingers is adapted to be inserted between the panel and a first inside wall surface of the channel portion. There is also a wedging member adapted for insertion between the panel and a second inside wall surface of the channel portion opposite the first inside wall surface. Accordingly, when the jamb is assembled, the fingers can resiliently bias the panel towards the wedging member.

In a preferred embodiment, the wedging member also includes resilient fingers, and the first member and a room wall can sandwich a second channel member so as to permit adjustment of the distance between the first member and the wall.

In another preferred embodiment, the sealing member and the wedging member also has finger elements.

In another aspect, a body member has a channel portion for reception of a section of a panel, and there is at least one flange member extending laterally from the body member, as well as a plurality of resilient sealing fingers extending in transverse fashion into the channel portion both of which are formed as one piece therewith. A combined wedging and sealing member is inserted between the panel and an inside wall surface of the channel portion.

In yet another preferred embodiment, there are two such flange members extending laterally from the body member that are positioned at essentially a right angle with respect to the body member.

In still another preferred embodiment, the body member is essentially U-shaped, and there are two such flange members extending laterally therefrom, and the flange members are positioned at a right angle with respect to each other.

In an additional embodiment, the body member is essentially U-shaped, and there are three flange members extending from the body member. The three flange members all extending from the body member at angles other than a right angle, and two of the flange members are positioned opposite each other.

The adjustable wall jambs of this invention afford various adjustments with respect to wall variations. At the same time, the adjustable wall jambs are easy to use from an adjustment standpoint.

The objects of the invention therefore include:

a. providing an adjustable wall jamb which can accommodate a wide variety of wall variations and configurations;

b. providing an adjustable wall jamb of the foregoing type which affords a tight water seal for a bathing fixture wall;

c. providing an adjustable wall jamb of the foregoing type which can be easily manufactured and used; and d. providing an adjustable wall jamb of the foregoing type in which a sealing member affords an adjustment feature.

These and still other objects and advantages of the invention will be apparent from the description which follows. In the detailed description below, the preferred embodiments of the invention will be described in reference to the accompanying drawings. The embodiments do not represent the full scope of the invention. Rather the invention may be employed in other embodiments.

DESCRIPTION OF THE PREFERRED EMBODIMENTS

Figure 1:
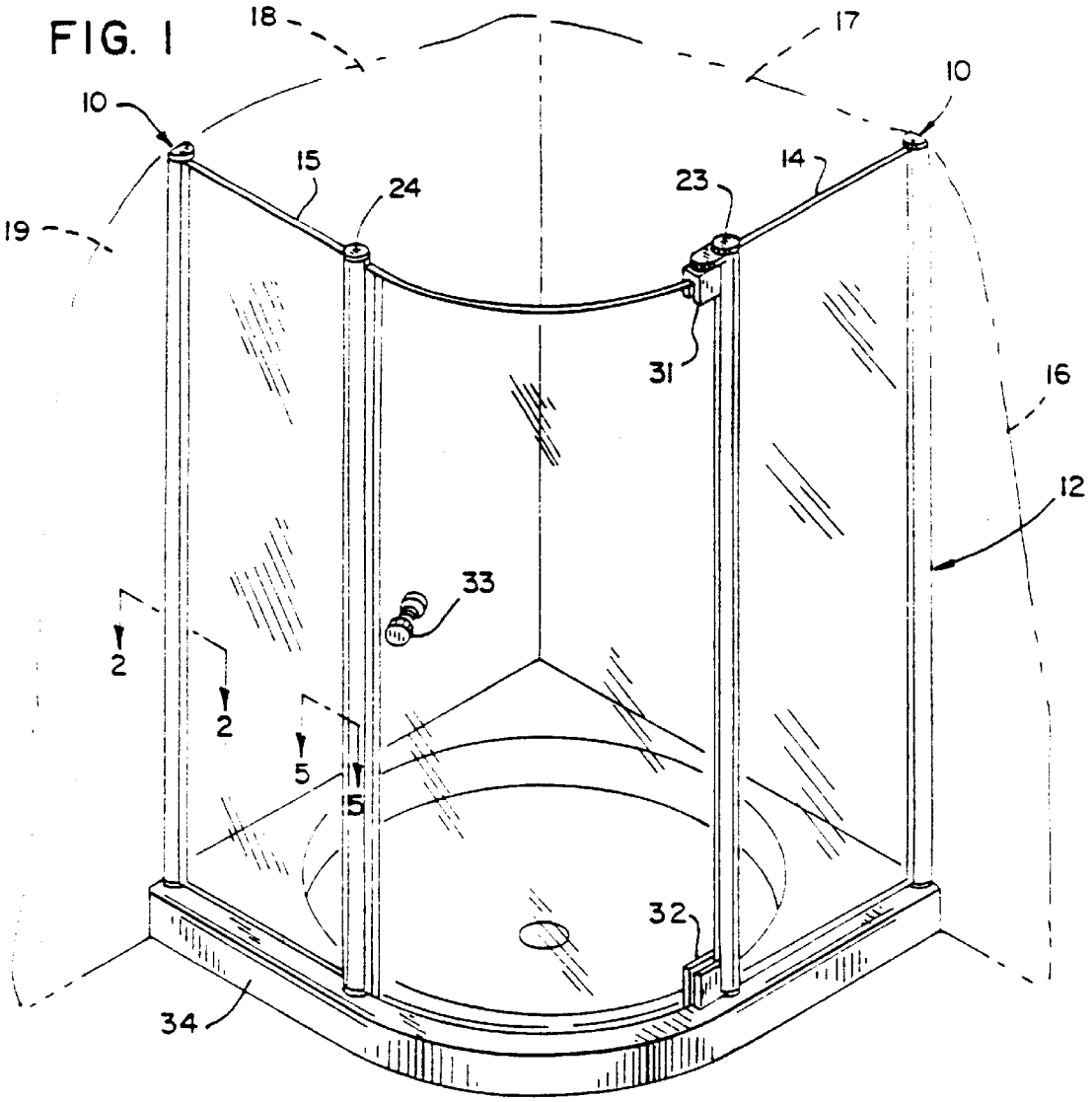
FIG. 1 is a top front perspective view showing a bathing fixture which incorporates an embodiment of the adjustable wall jamb of the present invention.
Figure 2:
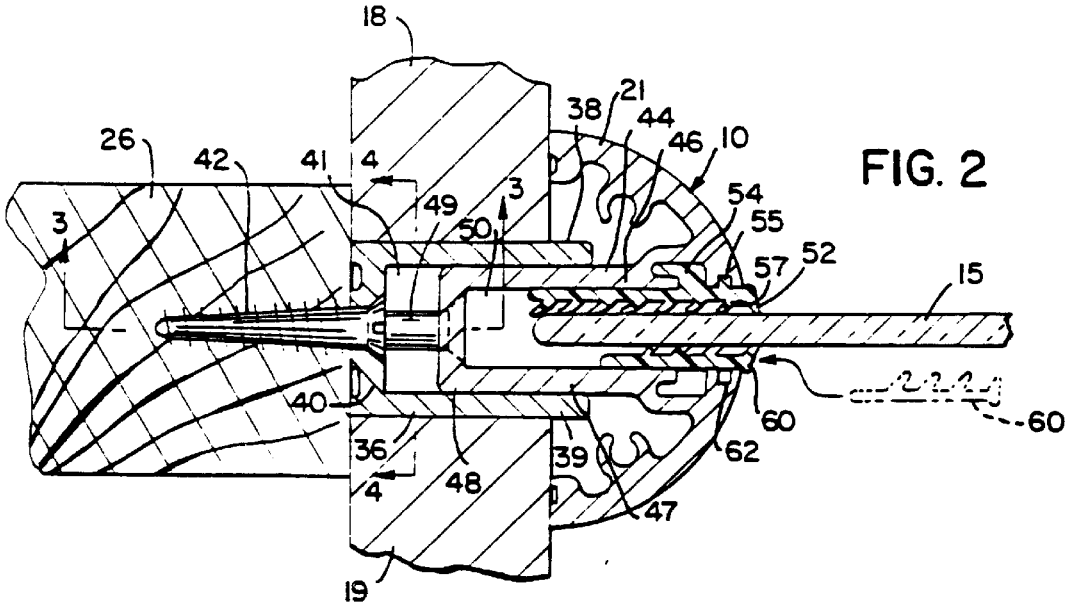
FIG. 2 is a sectional view taken along line 2—2 of FIG. 1.

Referring to FIGS. 1 and 2, a bathing fixture (e.g. a shower enclosure), generally 12, is shown having side walls 14 and 15 connected to room walls 16–19 by the wall jambs 10 of this invention which in effect provide a support post. Intermediate posts 23 and 24 are connected at the opposite ends of side walls 14 and 15 with the curved door 30 pivotally attached to the post 23 by the hinges 31 and 32. There is also provided the handle 33 for door 30, as well as a receptor base 34.

Referring specifically to FIG. 2, it is seen that the adjustable wall jamb 10 includes a stud jamb or mounting member 36 positioned between walls 16 and having side walls 38 and 39 and a base wall 40 to provide a vertically extending cavity 41. A screw 42 is placed through the base wall 40 to secure the mounting member 36 to the wall stud 26.

The wall jamb 10 is formed from an aluminum extrusion 21 and has an inwardly projecting portion 44 having the side walls 46 and 47, as well as a base wall 48. This provides a channel 50 for the positioning of a portion of wall 15 therein. A first sealing member 52 has the flanges 54 and 55 secured in the wall post 21 by suitable accommodating slots. The seal 52 has a plurality of flexible fingers 57 for engagement with the wall 15 and is positioned at the "wet side" of the wall 15.

At the opposite side, there is a wedging seal member 60 which also has flexible fingers 62 for engagement with the wall 15. Both seal 52 and wedging member 60 are preferably formed from coextrusions of flexible and rigid vinyl plastic materials such as a Geon 83457 and 87256 plastic from the B. F. Goodrich Co. The main body sections of seal 52 and wedging member 60, which in the instance of seal 52 extend flanges 54 and 55 are formed from the rigid plastic, whereas the fingers 57 and 62 are formed from the flexible plastic.

Figure 3:
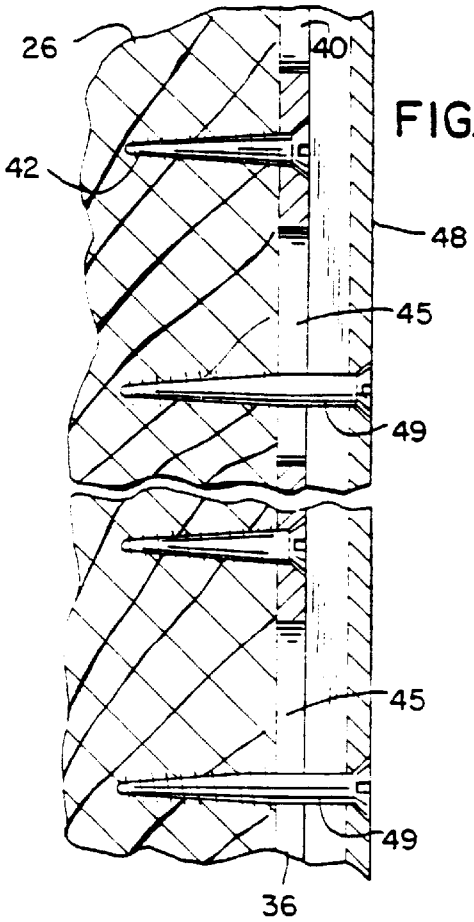
FIG. 3 is a sectional view taken along line 3—3 of FIG. 2.
Figure 4:
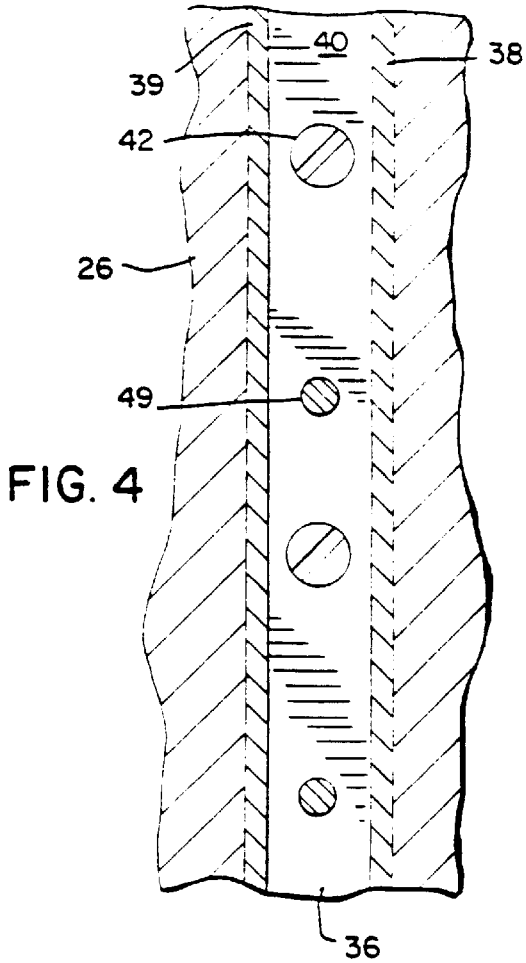
FIG. 4 is a sectional view taken along line 4—4 of FIG. 2.

Referring specifically to FIGS. 3 and 4, it is seen that wall jamb 10 is attached to the wall stud 26 by the screws 49. These pass through the adjustment slots 45 in the base wall 40 of the mounting member 36.

Figure 5:
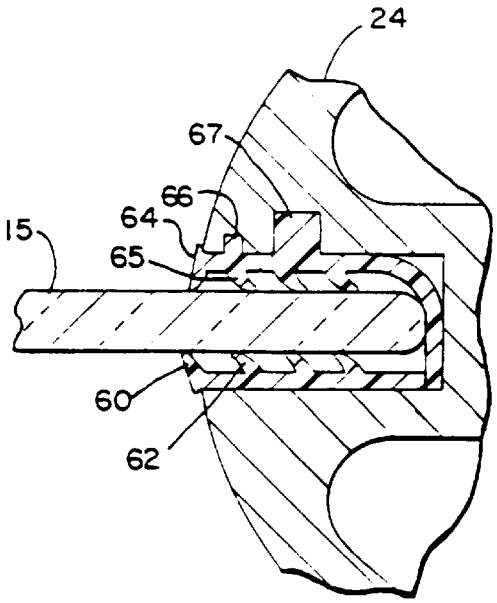
FIG. 5 is a sectional view taken along line 5—5 of FIG. 1.

FIG. 5 shows the opposite end of the side wall 15 secured in the intermediate post 24. This is effected by the seal 64 having the flexible flanges 66 and 67 accommodated in suitable slots in the extruded post 24. The seal 64 has resilient fingers 57 for contact with the side wall 15, as well as an end portion 68 which acts as a protective cover for the end of the side wall 15. Previously described wedge 60 is also employed at the opposite side of seal 64.

Figure 6:
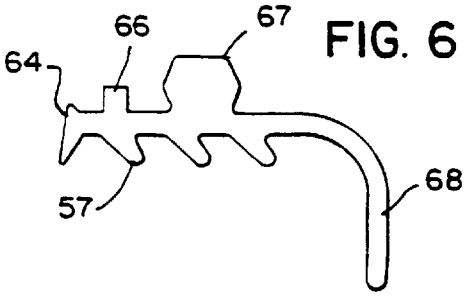
FIG. 6 is a top plan view of a sealing member prior to use in the FIG. 5 construction.

Referring specifically to FIG. 6, it is seen that the portion 67 of seal 64 assumes in a non-stressed state a generally pentagonal top view shape rather than a rectangular one as shown when jammed in post 24. This affords a compression effect on the flange when placed in the post and accordingly holds the seal 64 therein.

Figure 7:
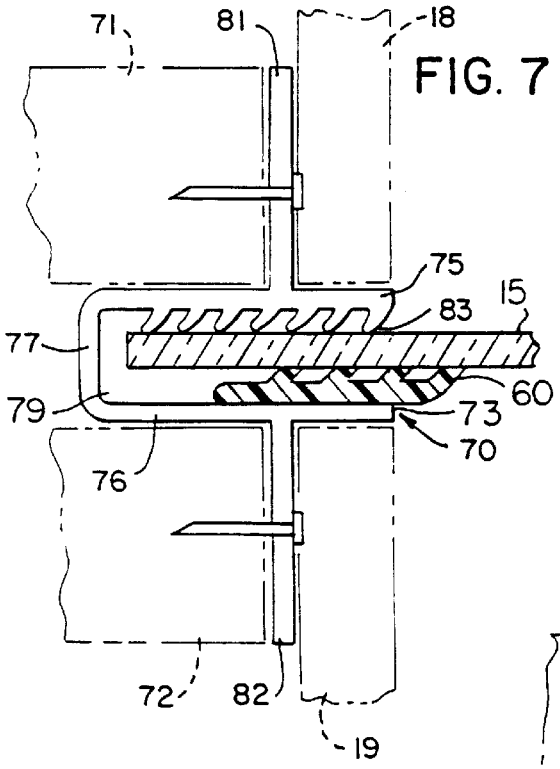
FIG. 7 is a top plan view of a second embodiment.

Referring to FIG. 7, there is shown an additional embodiment, generally 70, of a preferred alternative adjustable wall jamb which has a body member 73 placed between the wall studs 71 and 72, as well as the finish walls 18 and 19. The body member 73 includes the side walls 75 and 76, as well as a base wall 77 to afford a channel 79 for a portion of the glass 15 to be positioned therein. Flanges 81 and 82 extend from opposite sides of the body member 73 for purposes of permitting a nailing-in attachment through the flanges into the studs 71 and 72 behind the finish walls 18 and 19. Sealing fingers 83 extend from wall 75 to engage a panel wall in the same manner that fingers 57 engage wall 15 as shown in FIG. 2. In a like manner, a wedge 60 can be inserted in the opposing side.

Figure 8:
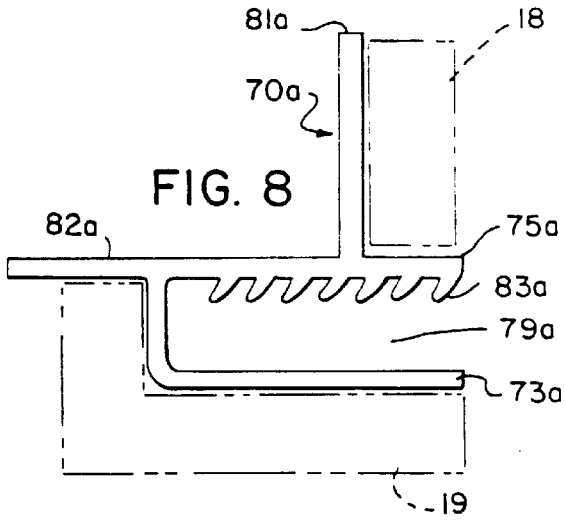
FIG. 8 is a top plan view of a third embodiment.
Figure 9:
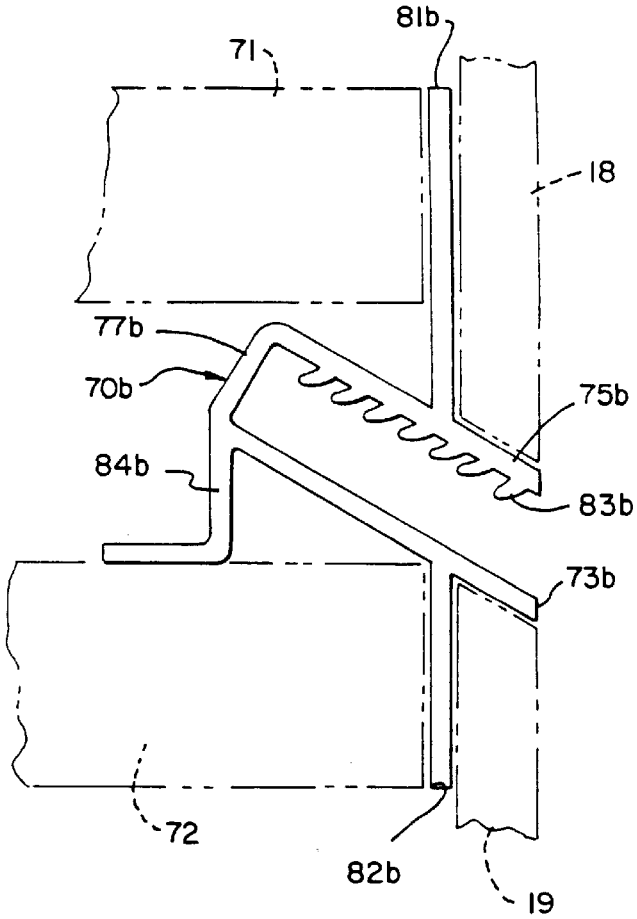
FIG. 9 is a view similar to FIG. 7, albeit a fourth embodiment.

Alternative embodiments are shown in FIGS. 8 and 9 with the same or similar component part designated by the same numbers except with an "a" suffix. With respect to embodiment 70*a*, this particular embodiment could be utilized for a corner installation with the flanges 81*a* and 82*a* nailed to a wall stud.

Embodiment 70*b* shown in FIG. 9 is for purposes of an angular installation. It is seen that the body member 73*b* passes between the finish walls 18 and 19 at an oblique angle. This embodiment has a third additional flange 84*b* for nailing to wall stud 72.

The body members 73, 73*a* and 73*b* are extruded from the same vinyl plastics as previously described for seal 52 and wedging member 60. The fingers such as 83 would all be formed from the flexible plastic and in a one-piece construction with the body members such as 73 which would be rigid. Seal 64 is coextruded in a similar manner except that portion 67 is flexible.

An important feature of the adjustable wall jamb is the fact that compensation can be made when a wall is not plumb in that the wall panel 15 does not have to be inserted completely into a holding slot such as channel 50. Thus, it can be situated in a "floating" but secured position. The flexible fingers allow the adjustment without scratching the panel 15.

Compensation can also made for any variations in the thickness of the finish walls such as 16–19 by the adjustable telescoping of projecting portion 44 into the cavity 41 of the stud jamb 36. This is best seen in conjunction with FIG. 2 where the projecting portion 44 does not completely seat in the stud jamb 36.

The embodiments shown in FIGS. 7, 8 and 9 afford a more simplified unit and yet still afford the "floating channel" feature. While not shown in these views, and as indicated previously, the wedging member 60 would also be employed at the opposite side of the panel to that of the fingers such as 83.

Another important feature is the fact that the fingers 57 of the seal 52 (or the fingers such as 83 of the embodiment 70) permit slidable adjustment of the wall 15 in the respective channels 50 and 79 and prior to insertion of the wedge 60, while still permitting the wedge to be inserted without harming panel 15.

Thus, the invention provides an improved adjustable wall jamb. While preferred embodiments have been described above, it should be readily apparent that those skilled in the art from this disclosure that a number of modifications and changes may be made without departing from the spirit and scope of the invention.

For example, while the adjustable wall jamb 10 has been shown in conjunction with a particular sealing and wedging arrangement in the post 24, other suitable sealing devices could be employed. With respect to the embodiments shown in FIG. 9, fingers such as 83 have been shown in conjunction with one particular wall of the body member. If desired, they could be employed on the other wall which would be the "wet side". Also, the specific materials mentioned, are not the only materials which can be used. All such and other modifications within the spirit of the invention are meant to be within the scope thereof.

We claim:

1. A combined wall jamb and seal device for a panel comprising:

a body member defining a channel portion for reception of a section of a panel;

at least one flange member extending laterally from the body member, the flange member having a fastener projecting therethrough for mounting said body member to a wall support; and a plurality of resilient sealing fingers extending in transverse fashion into the channel portion, the flange member and sealing fingers being formed as one piece; and an additional wedging and sealing member being inserted into said channel portion and having flexible fingers being adapted to engage the panel when inserted between the panel and an inside wall surface of the channel portion opposite the sealing fingers.

2. The combined wall jamb and seal device as defined in claim 1, wherein the body member is essentially U-shaped and there are three flange members extending from the body member, the three flange members all extending from the body member at angles other than a right angle.

3. The combined wall jamb and seal device as defined in claim 1, wherein two of the flange members are positioned opposite each other.

4. The combined wall jamb and seal device of claim 1, wherein the wall jamb and seal device are constructed and arranged to receive a bathing fixture wall.

* * * * *

UNITED STATES PATENT AND TRADEMARK OFFICE

CERTIFICATE OF CORRECTION

PATENT NO. : 6,023,889
DATED : February 15, 2000
INVENTOR(S) : Thomas J. Husting, Thomas A. Bonnell It is certified that error appears in the above-identified patent and that said Letters Patent is hereby corrected as shown below:

Claims,
Line 2, of claim 3, replace "[1]" with -- 2 --.

Signed and Sealed this

Fifth Day of February, 2002

*Attest:*

*Attesting Officer*

JAMES E. ROGAN
*Director of the United States Patent and Trademark Office*